US008088026B2

(12) United States Patent
Chen et al.

(10) Patent No.: US 8,088,026 B2
(45) Date of Patent: Jan. 3, 2012

(54) PHASE TRANSITION GOLF BALL AND METHOD OF USE

(75) Inventors: John Chu Chen, Hockessin, DE (US); Janice V. Granato, West Chester, PA (US); Matthew S. Hall, Landenberg, PA (US); Peter A. Morken, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 391 days.

(21) Appl. No.: 11/906,730

(22) Filed: Oct. 3, 2007

(65) Prior Publication Data

US 2008/0081710 A1 Apr. 3, 2008

Related U.S. Application Data

(60) Provisional application No. 60/849,111, filed on Oct. 3, 2006.

(51) Int. Cl.
*A63B 37/00* (2006.01)

(52) U.S. Cl. ..... 473/351; 473/409

(58) Field of Classification Search ..... 473/351, 473/409

See application file for complete search history.

(56) References Cited

U.S. PATENT DOCUMENTS

| | | | |
|---|---|---|---|
| 3,344,014 | A | 9/1967 | Rees |
| 4,248,990 | A | 2/1981 | Pieski et al. |
| 4,264,075 | A | 4/1981 | Miller et al. |
| 4,274,637 | A | 6/1981 | Molitor |
| 4,323,247 | A | 4/1982 | Keches et al. |
| 4,337,947 | A | 7/1982 | Saito et al. |
| 4,351,931 | A | 9/1982 | Armitage |
| 4,398,000 | A | 8/1983 | Kataoka et al. |
| 4,526,375 | A | 7/1985 | Nakade |
| 4,567,219 | A | 1/1986 | Tominaga et al. |
| 4,674,751 | A | 6/1987 | Molitor et al. |
| 4,846,910 | A | 7/1989 | Brown |
| 4,884,814 | A | 12/1989 | Sullivan |

(Continued)

FOREIGN PATENT DOCUMENTS

GB 2 384 997 A 8/2003

(Continued)

OTHER PUBLICATIONS

"Golf Balls: Slicing Through the Hype", Consumer Reports, vol. 71(5), pp. 30-34, (May 2006).

(Continued)

*Primary Examiner* — Raeann Gorden

(74) *Attorney, Agent, or Firm* — Maria M. Kourtakis; Kelly Law Registry

(57) ABSTRACT

A phase transition golf ball comprises a phase transition material. The phase transition material may optionally include a microwave susceptor or an induction susceptor. The phase transition material preferably comprises an ethylene acid copolymer, or an ionomer of an ethylene acid copolymer. The performance of the phase transition golf ball, for example its hardness or compression, is adjusted by inducing a complete or partial phase transition in the phase transition material. The extent of the adjustment in performance is correlated with the extent of the phase transition. Preferably, the phase transition is reversible and repeatable and takes place at temperatures that might be achieved through the use of common household appliances. Also preferably, the phase transition material returns to its original state over an extended period, for example hours or days.

19 Claims, 3 Drawing Sheets

U.S. PATENT DOCUMENTS

| | | | |
|---|---|---|---|
| 4,911,451 | A | 3/1990 | Sullivan et al. |
| 4,984,804 | A | 1/1991 | Yamada et al. |
| 4,986,545 | A | 1/1991 | Sullivan |
| 5,000,459 | A | 3/1991 | Isaac |
| 5,028,674 | A | 7/1991 | Hatch et al. |
| 5,068,151 | A | 11/1991 | Nakamura |
| 5,098,105 | A | 3/1992 | Sullivan |
| 5,120,791 | A | 6/1992 | Sullivan |
| 5,155,157 | A | 10/1992 | Statz et al. |
| 5,197,740 | A | 3/1993 | Pocklington et al. |
| 5,222,739 | A | 6/1993 | Horiuchi et al. |
| 5,253,871 | A | 10/1993 | Viollaz |
| 5,298,571 | A | 3/1994 | Statz et al. |
| 5,321,089 | A | 6/1994 | Cadorniga et al. |
| 5,328,959 | A | 7/1994 | Sullivan |
| 5,330,837 | A | 7/1994 | Sullivan |
| 5,338,038 | A | 8/1994 | Cadorniga |
| 5,338,610 | A | 8/1994 | Sullivan |
| 5,359,000 | A | 10/1994 | Hamada et al. |
| 5,368,304 | A | 11/1994 | Sullivan et al. |
| 5,567,772 | A | 10/1996 | Hagman et al. |
| 5,757,483 | A | 5/1998 | Pierce, III |
| 5,810,678 | A | 9/1998 | Cavallaro et al. |
| 5,873,796 | A | 2/1999 | Cavallaro et al. |
| 5,971,870 | A | 10/1999 | Sullivan et al. |
| 5,971,871 | A | 10/1999 | Sullivan et al. |
| 5,971,872 | A | 10/1999 | Sullivan et al. |
| 5,973,046 | A | 10/1999 | Chen et al. |
| 5,976,443 | A | 11/1999 | Nesbitt et al. |
| 5,998,771 | A | 12/1999 | Mariano et al. |
| 6,018,003 | A | 1/2000 | Sullivan et al. |
| 6,096,830 | A | 8/2000 | Takemura et al. |
| 6,130,411 | A | 10/2000 | Rockenfeller et al. |
| 6,229,132 | B1 | 5/2001 | Knetter |
| 6,247,469 | B1 | 6/2001 | Guard |
| 6,562,906 | B2 | 5/2003 | Chen |
| 2005/0049367 | A1 | 3/2005 | Rajagopalan et al. |
| 2006/0124892 | A1 | 6/2006 | Rolland et al. |
| 2006/0148590 | A1* | 7/2006 | Sullivan et al. ..... 473/371 |
| 2006/0196497 | A1 | 9/2006 | Dean |

FOREIGN PATENT DOCUMENTS

| | | |
|---|---|---|
| WO | WO 99/48569 | 9/1999 |
| WO | WO 00/63309 | 10/2000 |

OTHER PUBLICATIONS

PCT International Search Report and Written Opinion for International Application No. PCT/US2007/021261 dated Feb. 1, 2008.

Loo et al. "Thin crystal melting produces the low-temperature endotherm in ethylene/methacrylic acid ionomers," Polymer 46 (2005) 5118-5124.

* cited by examiner

PHASE TRANSITION GOLF BALL AND METHOD OF USE

This application claims the benefit of U.S. Provisional Application No. 60/849,111, filed Oct. 3, 2006, which is incorporated herein by reference in its entirety.

FIELD OF THE INVENTION

The present invention is directed to customizing the performance of a golf ball. Specifically, a performance property of a golf ball comprising a phase transition material, for example its hardness or stiffness, is adjusted by inducing a complete or partial phase transition in the phase transition material.

BACKGROUND OF THE INVENTION

Several patents and publications are cited in this description in order to more fully describe the state of the art to which this invention pertains. The entire disclosure of each of these patents and publications is incorporated by reference herein.

Both professional golf players and amateurs of the game desire to improve the level of their play by using equipment that provides optimal performance. Golf ball performance, therefore, is an active field of research and development, and advances in golf ball technology are anticipated with interest by golf players of every stripe.

Golf ball performance is determined largely by the physical properties of the ball, or, more precisely, by the properties of the materials from which the ball is made. Recently, for example, manufacturers have been able to supply the market with polymer compositions that offer both superior softness and a high coefficient of resilience (COR). See, e.g., U.S. Pat. No. 6,562,906, issued to John Chu Chen. This particular combination of properties is highly desirable, because softness is correlated with better control of the ball, and high resilience is correlated with longer shot distance.

There are some generally accepted guidelines about what balance of properties is best for players at different levels of skill or with different styles of play. See, for example, "Golf Balls: Slicing through the Hype" *Consumer Reports*, Vol. 71(5), p. 30 (May, 2006.) Beyond these broad guidelines, however, and often superseding them, are the player's personal preferences, which may in cases be idiosyncratic.

Therefore, it is desirable to provide a golf ball whose physical properties, and, consequently, whose performance can be tailored to the skills or preferences of an individual player. Preferably, the means of tailoring the properties is convenient, straightforward, and accessible to the typical golfer.

Heating or cooling a golf ball is one approach to tailoring golf ball performance that meets these criteria. The relationship between the temperature of a traditional golf ball and its performance has long been recognized. In fact, most golfers are aware that heating or cooling traditional golf balls to temperatures no more extreme than those that might be achieved by a change in the weather can have a significant effect on the golf balls' performance properties.

Briefly, when a golf ball is fabricated with traditional polymeric materials, a decrease in temperature leads to increased stiffness. This is a simple thermal effect, which is not necessarily caused by a glass transition or any other phase change. Perhaps the best known example of this phenomenon is the temperature-induced hardening of the O-ring seals used on the space shuttle Challenger, which the late Professor Richard Feynman illustrated so dramatically by immersing a sample of the polymeric O-ring material in a glass of ice water.

Significantly, the changes in physical properties that are caused by simple thermal effects at cooler temperatures result in deleterious effects on the performance of the traditional golf ball. It is well known, for example, that increased stiffness causes the golfer to have a less favorable feeling of the golf ball's responsiveness and its connection with the club. Increased stiffness also results in less control of the spin of the traditional golf ball, when it rebounds from the face of the golf club.

Moreover, when a golf ball is fabricated with traditional materials, the property changes are essentially simultaneous with the material's temperature change. That is, the performance change due to heating or cooling is realized approximately contemporaneously with the change in the golf ball's temperature. For this reason, during cold weather it is considered necessary by some to carry the traditional golf ball in a heating device throughout the round of golf, in order to maintain a relatively more favorable performance. See, for example, U.S. Pat. No. 5,998,771, issued to Mariano et al.; U.S. Pat. No. 6,130,411, issued to Rockenfeller et al.; and U.S. Pat. No. 6,229,132, issued to Knetter.

Therefore, it would be advantageous to develop a golf ball whose properties can be adjusted to individual preferences by easy and convenient means, for example by heating. It would also be advantageous for the property change to persist over a period of time that is greater than or equal to the average duration of a golf game, and to be robust in the face of ambient temperature changes that adversely affect the traditional golf ball's performance, so that golfers need not be burdened, on or off the course, with the added expense and superfluous clutter of golf ball heating devices.

SUMMARY OF THE INVENTION

Accordingly, the present invention provides a phase transition golf ball that comprises a phase transition material. The phase transition material may optionally include a microwave susceptor or an induction susceptor. The phase transition material preferably comprises an ethylene acid copolymer, an ionomer of an ethylene acid copolymer, or a blend of an organic acid or a salt of an organic acid with an ethylene acid copolymer or an ionomer of an ethylene acid copolymer. One or more performance properties of the phase transition golf ball, for example its hardness or stiffness, is adjusted by inducing a complete or partial phase transition in the phase transition material. The extent of the adjustment in performance is correlated with the extent of the phase transition. Preferably, the phase transition is reversible and repeatable and takes place at temperatures that might be achieved using common household appliances. Also preferably, the phase transition material returns to its original state over an extended period, for example hours or days. Thus, no additional equipment, such as a golf ball heating device, is necessary in order to maintain the performance adjustment throughout one or more rounds of golf.

DETAILED DESCRIPTION OF THE INVENTION

Figure 1:
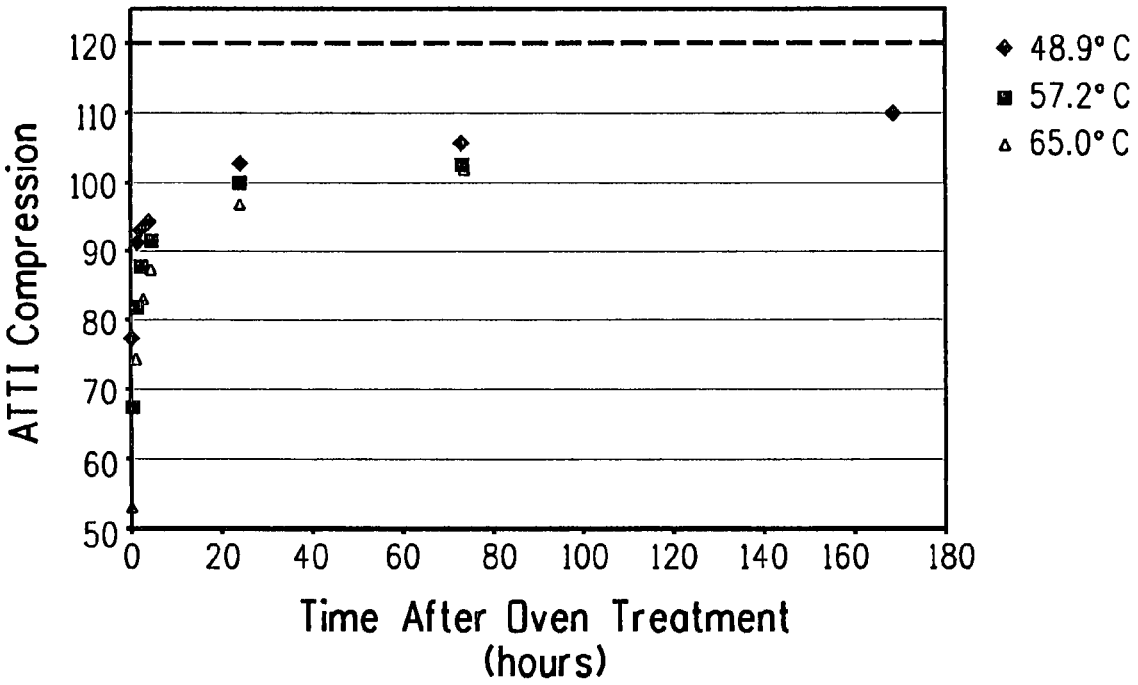
FIG. 1 is a graph showing the effect of heating on the ATTI compression of spheres of a first phase transition material.

The definitions herein apply to the terms as used throughout this specification, unless otherwise limited in specific instances.

The terms "finite amount" and "finite value" refer to an amount that is greater than zero.

The term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such.

When the term "about" is used in describing a value or an end-point of a range, the disclosure should be understood to include the specific value or end-point referred to.

The term "or", as used herein, is inclusive; more specifically, the phrase "A or B" means "A, B, or both A and B". Exclusive "or" is designated herein by terms such as "either A or B" and "one of A or B", for example.

In addition, the ranges set forth herein include their end-points unless expressly stated otherwise. Further, when an amount, concentration, or other value or parameter is given as a range, one or more preferred ranges or a list of upper preferable values and lower preferable values, this is to be understood as specifically disclosing all ranges formed from any pair of any upper range limit or preferred value and any lower range limit or preferred value, regardless of whether such pairs are separately disclosed.

When materials, methods, or machinery are described herein with the term "known to those of skill in the art", or a synonymous word or phrase, the term signifies that materials, methods, and machinery that are conventional at the time of filing the present application are encompassed by this description. Also encompassed are materials, methods, and machinery that are not presently conventional, but that will have become recognized in the art as suitable for a similar purpose.

As used herein, the terms "comprises," "comprising," "includes," "including," "containing," "characterized by," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The transitional phrase "consisting of" excludes any element, step, or ingredient not specified in the claim, closing the claim to the inclusion of materials other than those recited except for impurities ordinarily associated therewith. When the phrase "consists of" appears in a clause of the body of a claim, rather than immediately following the preamble, it limits only the element set forth in that clause; other elements are not excluded from the claim as a whole.

The transitional phrase "consisting essentially of" limits the scope of a claim to the specified materials or steps and those that do not materially affect the basic and novel characteristic(s) of the claimed invention. "A 'consisting essentially of' claim occupies a middle ground between closed claims that are written in a 'consisting of' format and fully open claims that are drafted in a 'comprising' format." Optional additives as defined herein, at levels that are appropriate for such additives, and minor impurities are not excluded from a composition by the term "consisting essentially of", however.

Where an invention or a subcombination thereof is described with an open-ended transitional phrase such as "comprising," unless otherwise stated in specific instances, the term should be interpreted to include a description of the invention or subcombination using the transitional phrases "consisting essentially of" and "consisting of". Likewise, unless otherwise stated, an invention or subcombination described using the transitional phrase "consisting essentially of" also includes a description of the invention or subcombination using the transitional phrase "consisting of".

The indefinite articles "a" and "an" are employed to describe elements and components of the invention. The use of these articles means that one or at least one of the elements or components so modified is present. Although these articles are conventionally employed to signify that the modified noun is a singular noun, as used herein the articles "a" and "an" also include the plural, unless otherwise stated in specific instances. Similarly, the definite article "the", as used herein, also signifies that the modified noun may be singular or plural, again unless otherwise stated in specific instances.

Polymers may be defined herein by reference to the monomers used to make them or by the amounts of the monomers used to make them. Such a description may not include a formal nomenclature commonly used to describe the final polymer, or may not contain product-by-process terminology. Nevertheless, any such reference to monomers or amounts of monomers means that the polymer is made from those monomers or from those amounts of the monomers, and also refers to the corresponding polymers and compositions thereof.

All percentages, parts, ratios, and the like set forth herein are by weight, unless otherwise stated in specific instances.

The term "(meth)acrylic", as used herein, alone or in combined form, such as "(meth)acrylate", refers to acrylic and/or methacrylic, for example, acrylic acid and/or methacrylic acid, or alkyl acrylate and/or alkyl methacrylate.

Finally, the term "phase transition", as used herein, refers to a change in the nature of a phase or in the number of phases as a result of some variation in externally imposed conditions, such as temperature. IUPAC Compendium of Chemical Terminology, 2nd Edition (1997).

The term "phase transition", however, excludes changes to golf ball components that result from increased pressure, such as might be exerted by striking a golf ball with a golf club under conditions that are typical of normal play. The term "phase transition" also excludes changes to golf ball components that consist essentially of polyurethane, thermoset rubber, or liquids that are presently conventional for use as components in golf balls.

Finally, when referring to binary phase transitions, e.g., a secondary crystal structure is present or is disrupted, the "extent of the phase transition" refers to the relative proportion of phase change material that has undergone the phase transition. Also, phase changes in materials that are not yet conventional for use as components in golf balls, but that may be recognized in the future as suitable for such uses, are included in the term "phase transition".

A "phase transition golf ball" is a golf ball that comprises a phase transition material. Suitable phase transition materials include any material that is subject to a phase transition, and whose phase transition does not render it unsuitable for use in a golf ball. The physical properties of the phase transition material, and therefore those of the phase transition golf ball, change as a result of the phase transition. Preferably, this physical property change results in an advantageous change in the performance of the phase transition golf ball. Lower compression, that is, increased softness, is one example of an advantageous change.

Specific examples of suitable phase transition materials include, without limitation, paraffin waxes, copolymers of ethylene and vinyl acetate, ethylene acrylate copolymers, acid copolymers, and ionomers of acid copolymers. These materials undergo phase transitions such as melting and solidification, changing from a crystalline to a more amorphous state, and glass transitions. Suitable paraffin waxes include those described in U.S. Patent Appln. Publn. No. 20060124892, by Rolland et al. Suitable copolymers of ethylene and vinyl acetate and suitable ethylene acrylate copolymers are described in U.S. Patent Appln. Publn. No. 20060196497, by David M. Dean, and in the references cited therein.

Some phase transition materials that consist essentially of paraffin waxes, ethylene acrylate copolymers, or copolymers of ethylene and vinyl acetate may be unsuitable for use in golf balls. Blends of these materials that are suitable for use in golf balls may be included in the phase transition golf balls and in the methods of the present invention, however, provided that the blends also exhibit a phase transition or a property change that may be attributable to a phase transition of the paraffin waxes, ethylene acrylate copolymers, or copolymers of ethylene and vinyl acetate. The materials with which the paraffin waxes, the ethylene acrylate copolymers or the copolymers of ethylene and vinyl acetate may be blended are described in detail below.

Preferred phase transition materials include acid copolymers and ionomers of acid copolymers. These materials undergo a phase transition when their secondary crystal structure is disrupted, typically at temperatures ranging from about 350 to about 70° C. and preferably from about 50° to about 60° C.

Equilibrium, near-equilibrium or non-equilibrium heating methods may be used to raise the temperature of the phase transition material or the phase transition golf ball. Suitable heating methods include conduction, convection, and radiation. More specifically, the temperature of the phase transition material or the phase transition golf ball may be raised in a warm water bath, a boiling water bath, a steam bath, a conventional oven, in another environment with a temperature higher than ambient, such as a glove compartment or the trunk of a car, in a microwave oven, by removal from a cold environment such as the interior of a refrigerator, or by magnetic or electromagnetic induction, for example. In this connection, as is set forth in greater detail below, the phase transition material or the phase transition golf ball may also include a microwave susceptor or an induction susceptor.

When the phase transition material includes an acid copolymer or an ionomer of an acid copolymer, many of the ball's performance properties are directly affected by the changes in the phase transition material's physical properties that result from the disruption of its secondary crystal structure. The affected performance properties include, for example, spin, initial velocity, hardness, launch angle, compression, and resilience. Advantageously, however, the resilience of the acid copolymer or ionomer remains relatively constant, compared to the extent of the decrease in their compression.

The favorable properties of phase transition golf balls are discussed below with reference to acid copolymers and ionomers of acid copolymers. This is as a matter of convenience, so that the physical properties of the phase transition material may be specifically related to the extent of disruption of the secondary crystal structure. It is to be understood, however, that the benefits offered by the preferred phase transition materials, or similar benefits, are also available through the use of the other suitable phase transition materials described herein.

In particular, the extent of the changes to the phase transition material's physical properties, and therefore the extent of the changes in the golf ball's performance, correlate to the extent of the disruption of the secondary crystal structure. Thus, the performance of the phase transition golf ball is variable. Further, upon mapping the ball's performance properties with the phase diagram of the phase transition material, the performance is also empirically correlated, or predictable. For even better tailoring accuracy and even greater convenience, the phase diagram can be in the form of a chart of the properties of the phase transition golf ball vs. its temperature. Thus, it is possible to alter the phase transition golf ball's performance to a predetermined extent, based on the temperature to which the golf ball is heated. Stated alternatively, the performance of the phase transition golf ball is customizable.

The disruption of the secondary crystal structure in an acid copolymer or ionomer is typically essentially simultaneous with the change in the polymer's temperature. The re-organization of the secondary crystal structure in these materials, however, generally occurs over a relatively long period of time when the phase transition golf ball is stored at room temperature, in some cases at least as long as four hours, eight hours, twelve hours; one, two, or three days; or one, two, three or four weeks. Consequently, when the performance of the golf ball is altered via disruption of the secondary crystal structure, the performance change persists for at least the approximate duration of a typical round of golf.

The length of the reorganization period may also be customized, by appropriate choice of polymer properties. For example, stiffer materials generally require less time to reorganize their secondary crystal structure. Specific molecular properties that may be varied to tailor the acid copolymer's or ionomer's reorganization time include, without limitation, the molecular weight, the content of acid comonomer, the content of softening monomer, the extent of neutralization, and the choice of neutralizing cation.

Significantly, because the secondary crystal structure reorganizes after a disruption, the alteration of the phase transition golf ball's performance is also temporary and reversible. After the reorganization time, the phase transition golf ball may be reheated to the same temperature, and its secondary crystal structure will be disrupted to about the same extent. Thus, the customization of the phase transition golf ball's performance properties is also repeatable, to within a reasonable approximation. Alternatively, the phase transition golf ball, post-reorganization, may be heated to a different temperature. Its secondary crystallinity will then be disrupted to a different extent, and its properties will be customized to a different individual, or to meet different preferences of the same individual.

In this connection, it is noted that the performance change due to the phase transition is believed to be cumulative, although not necessarily simply additive, with the simple thermal effects referred to above. Thus, a golfer using a phase transition golf ball according to this embodiment need not keep the temperature of the ball constant, for example with a ball heating device, in order to realize the performance benefits that result from the phase transition. When playing under extreme weather conditions, however, it may be desirable to keep the phase transition golf ball at a constant temperature. In this way, its performance will be dictated primarily by the phase transition, rather than by the thermal effects.

Alternatively, the extent of the phase transition, and therefore the extent of the customization, may take the weather conditions into account. For example, a golfer planning to play on an extremely warm day may wish to effect less of a disruption of the secondary crystal structure by heating the ball to a lower temperature, knowing that the golf ball will also be softened somewhat by equilibrating to the ambient temperature. Complementarily, a golfer planning to play on a particularly cold day may wish to effect more of a disruption of the secondary crystal structure by preheating the ball to a higher temperature, knowing that the golf ball will also be hardened somewhat by equilibrating to the ambient temperature.

Parenthetically, it is noted that the properties of traditional golf ball materials, such as polybutadiene rubbers, may be customizable via simple thermal effects. Even so, their performance is generally not affected to the same extent as that of a phase transition material. Stated alternatively, the range of compression, e.g., that may be attained by changing the temperature of the polybutadiene is much narrower than the range of compression that may be attained by partially or completely disrupting the secondary crystal structure of an acid copolymer or ionomer.

The acid copolymers suitable for use in the present invention are preferably copolymers of one or more alpha olefins. Suitable alpha olefins include those having from 2 to 6 carbons, and mixtures thereof. Examples of suitable alpha olefins include, without limitation, ethylene, propylene, 1-butene, isobutene, 1-pentene, 2-methyl-1-butene, 3-methyl-1-butene, and isomers of 1-hexene such as 1-hexene and 2-methyl-1-hexene. Ethylene is a particularly preferred alpha olefin.

Suitable acid comonomers for use in the acid copolymer include α,β-ethylenically unsaturated carboxylic acids having from 3 to 8 carbon atoms. Suitable carboxylic acids include, for example, acrylic acid, methacrylic acid, maleic acid, and maleic acid mono-ester (also referred to in the art as the "half-ester" of maleic acid). Acrylic acid and methacrylic acid are preferred acid comonomers for use in the present invention. One or more acid comonomers may be used to synthesize an acid copolymer.

Other suitable carboxylic acid monomers include but are not limited to: crotonic acid; itaconic acid; fumaric acid; haloacrylic acids such as chloroacrylic acid, for example; citraconic acid; vinylacetic acid; pentenoic acids; alkylacrylic acids; alkylcrotonic acids; alkenoic acids; alkylcrotonic acids; and alkylakanoic acids.

The preferred acid copolymers may optionally contain a third, softening monomer. The term "softening", as used in this context, refers to a disruption of the crystallinity of the copolymer. Preferred "softening" comonomers include, for example, alkyl(meth)acrylates wherein the alkyl groups have from about 1 to about 8 carbon atoms.

The preferred acid copolymers, when the alpha olefin is ethylene, can thus be described as E/X/Y copolymers, wherein E represents copolymerized ethylene, X represents the copolymerized α,β-ethylenically unsaturated carboxylic acid, and Y represents the copolymerized softening comonomer. X is preferably present at a level of about 0.1 to about 40 wt %, and Y is preferably present at a level of 0 to about 40 wt % of the acid copolymer.

More preferred are acid copolymers in which X is present at a level of about 1 to about 30 wt %, and Y is present at a level of about 0 to about 30 wt % of the acid copolymer. Still more preferably, X is present at a level of about 10 wt % to about 20 wt %.

Acid copolymers suitable for use in the present invention preferably have a weight average molecular weight ($M_w$) greater than about 30 kDa, and more preferably greater than about 40 kDa.

Examples of acid copolymers suitable for use in the present invention include ethylene/(meth)acrylic acid copolymers. Also included are ethylene/(meth)acrylic acid/n-butyl(meth)acrylate, ethylene/(meth)acrylic acid/iso-butyl(meth)acrylate, ethylene/(meth)acrylic acid/methyl(meth)acrylate, ethylene/(meth)acrylic acid/ethyl(meth)acrylate terpolymers, and the like.

Several preferred acid copolymers for use in the present invention are commercially available. These include Nucrel® acid copolymers, available from E.I. du Pont de Nemours & Co. of Wilmington, Del. ("DuPont").

Methods for preparing acid copolymers of ethylene are well known in the art. For example, acid copolymers may be prepared by the method disclosed in U.S. Pat. No. 4,351,931, issued to Armitage. This patent describes acid copolymers of ethylene comprising up to 90 weight percent of copolymerized ethylene. In addition, U.S. Pat. No. 5,028,674, issued to Hatch et al., discloses improved methods of synthesizing acid copolymers of ethylene when polar comonomers such as (meth)acrylic acid are incorporated into the copolymer, particularly at levels higher than 10 weight percent. Acid copolymers may also be produced by hydrolyzing ethylene acrylate copolymers. U.S. Pat. No. 4,248,990, issued to Pieski, describes the preparation and properties of acid copolymers synthesized at low polymerization temperatures and normal pressures. Other acid copolymers suitable for use in the invention include polymers grafted with carboxylic acid moieties via solution or melt processes, and polymers and copolymers of carboxylic acid containing comonomers made by aqueous dispersion, emulsion or solution polymerization or copolymerization. See, e.g., International Patent Publn. No. WO00/63309, by Capendale et al.

Ethylene acid copolymers with high levels of acid comonomer (X) may be prepared in continuous polymerization reactors, through the use of co-solvent technology as described in U.S. Pat. No. 5,028,674, or by employing higher reaction pressures than those at which copolymers with lower acid can be prepared.

An acid copolymer suitable for use in the invention may optionally be neutralized to any level that does not result in an intractable copolymer ionomer, i.e., one that is not melt processable or one that is without useful physical properties. With increasing preference in the order given, about 0.01 mol % to about 100 mol %, about 5 mol % to 100 mol %, about 1 mol % to about 90 mol %, about 5 mol % to about 75 mol %, about 20 mol % to about 60 mol %, or about 30 mol % to about 50 mol % of the acid moieties of the acid copolymer are neutralized by neutralizing agents of one or more compositions. It will be apparent to those of skill in the art that, in acid copolymers having a high acid level, for example more than 15 wt % of acid comonomer, the preferred extent of neutralization, as a percentage of total acid equivalents, is preferably somewhat lower, once more in order to retain melt processability.

Ionomers suitable for use in the present invention may comprise any feasible counterion or combination of positively charged counterions (cations). Preferred cations of the neutralized acid copolymers may be singly or doubly charged, e.g., monovalent or divalent. When the cations are metal cations, they are preferably selected from among alkali metals (Group 1), alkaline earth metals (Group 2), transition metals (Groups 3 through 12), lanthanides, and actinides. Preferred cations include lithium, sodium, potassium, magnesium, calcium, barium, copper, silver, zinc, mercury, tin, lead, bismuth, cadmium or chromium, ammonium, or a combination of two or more of these cations. More preferably, the cations are monovalent metal cations, such as alkali metal cations. Sodium, potassium, zinc, and magnesium are particularly preferred cations for use in the present invention.

Ionomers useful in the practice of the present invention include ionomers obtained from ethylene-co-(meth)acrylic acid (E/(M)AA) dipolymers having a weight average molecular weight ($M_w$) of from about 10 kDa to about 500 kDa.

Several preferred ionomers for use in the present invention are commercially available. These include Surlyn® ionomers, available from DuPont.

Methods of preparing ionomers are described in U.S. Pat. No. 3,344,014, issued to Rees, for example.

The acid copolymer or ionomer may be present in an amount of up to about 100 wt %, based on the total weight of the phase transition material. In increasing order of preference, the acid copolymer and/or ionomer may be present at a level of at least about 1 wt %, about 10 wt %, about 20 wt %, about 30 wt %, about 40 wt %, or about 50 wt %, based on the total weight of the phase transition material.

The acid copolymer or ionomer may also comprise one or more organic acids. The term "acid", as used herein with reference to organic acids, e.g., "fatty acid" and "stearic acid", and unless otherwise limited in specific instances, refers to an acid, a salt of the acid, or a mixture of the acid and one or more of its salts. Thus, an organic acid, as the term is used herein, may have carboxylic acid functionality (—C(O)OH), carboxylate functionality (—C(O)O⁻), or both carboxylic acid and carboxylate functionality.

Suitable organic acids for use in the present invention include nonvolatile, aliphatic organic acids. The suitable organic acids may be saturated or unsaturated. Preferably, the organic acids have from about 6 to about 38 carbon atoms.

Preferred organic acids for use in the present invention include fatty acids, that is, suitable organic acids having from 12 to 36 carbon atoms. Examples of preferred fatty acids include, without limitation, caproic acid, caprylic acid, capric acid, lauric acid, myristic acid, palmitic acid, stearic acid, oleic acid, linoleic acid, alpha-linolenic acid, dihomo-gamma-linolenic acid, erucic acid, behenic acid, butyric acid, arachidic acid, arachidonic acid, behenic acid, lignoceric acid, cerotic acid, lauroleic acid, myristoleic acid, pentadecanoic acid, palmitoleic acid, margaric acid, ricinoleic acid, elaidic acid, eleostearic acid, licanic acid, eicosenoic acid, eicosapentaenoic acid, docosahexaenoic acid, montanic acid, and isomers thereof. Citric acid is also a preferred organic acid.

Stearic acid, erucic acid, behenic acid, and oleic acid are more preferred fatty acids. Particularly preferred are branched derivatives of fatty acids, including, without limitation, derivatives of oleic acid such as 2-methyl oleic acid, and derivatives of stearic acid such as 2-methyl stearic acid. Also particularly preferred are the salts of organic acids that have branched alkyl substituents or unsaturation and that are non-crystalline at ambient temperatures, including, for example, isostearic acid salts and isooleic acid salts.

When present as salts, the organic acids may be neutralized with any feasible counterion or combination of counterions. A description of the feasible counterions is set forth above with respect to ionomers. Preferably, the counterion includes an alkali metal ion, a transition metal ion, or an alkaline earth metal ion, or a combination of two or more thereof. More preferably, the counterion is selected from potassium, sodium, lithium, magnesium, calcium, barium, gold, copper, silver, zinc, mercury, tin, lead, bismuth, cadmium or chromium ions, or combinations of two or more thereof. Particularly preferred salts include sodium, calcium, zinc, or magnesium ions, or a combination of two or more of sodium, calcium, zinc, or magnesium ions.

Preferably, the ethylene acid copolymer phase transition materials include one or more organic acids. Without wishing to be held to theory, it is known that blends of ethylene acid copolymers with organic acids are more receptive to radiofrequency (RF) energy and better able to convert RF energy to heat, compared to neat ethylene acid copolymers. Presumably, then, golf balls comprising an ethylene acid copolymer phase transition material that includes an organic acid will be more easily heated when subjected to an RF field, and will accordingly also be more efficiently customizable, compared to golf balls that comprise an ethylene acid copolymer but not an organic acid.

The organic acid or acids, when present, are preferably included in a finite amount of at least about 0.1 wt %, at least about 2 weight percent, or at least about 5 wt % of the total weight of the phase transition material. Also preferably, the one or more organic acids are present in a finite amount of up to about 10 wt %, 20 wt %, 25 wt %, 30 wt %, 35 wt %, 40 wt %, or 50 wt %, based on the total weight of the phase transition material. More preferably, and with increasing preference in the order given, the organic acid or acids are present in an amount of from about 0.1 wt % to about 50 wt %; from about 2 to about 40 wt %; from about 5 to about 35 wt %; from about 5 to about 30%; from about 5 to about 25%; or from about 5 to about 20 wt %, based on the total weight of the phase transition material.

When an organic acid is present in the ethylene acid copolymer phase transition material, the acid is preferably at least partially neutralized. With increasing preference in the order given, about 0.01 mol % to about 100 mol %, about 5 mol % to 100 mol %, about 20 mol % to about 100 mol %, about 30 mol % to about 100 mol %, about 40 mol % to about 100 mol %, or about 50 mol % to about 100 mol % of the acid moieties of the organic acid are neutralized by neutralizing agents of one or more compositions. The suitable and preferred neutralizing agents are as set forth above with respect to ionomers of acid copolymers.

In this connection, when one or more organic acids are present in the phase transition materials, they may be added to the polymer blend in the acid form, the salt form, or as a mixture of acid(s) and salt(s). It will be apparent to those of skill in the art that, with the high temperatures and shear rates of extruder processing, or over longer time periods in milder conditions, there will be equilibration, to some extent, between the level of neutralization of the organic acid, and the level of neutralization of the acid copolymer.

Thus, depending on the overall level of neutralization that is desired for the blend, it is possible to over neutralize the acid copolymer, and back titrate by adding the organic acid in its acid form. Conversely, it is possible to add the organic acid, completely neutralized, to an acid copolymer whose level of neutralization is below that which is desired for the polymer blend. Also, the neutralization of the acid copolymer and that of the organic acid can each be adjusted, before blending, to be equal to the desired final level of the phase transition material blend. Those of skill in the art recognize that other permutations are possible, and are able to determine which methods may be desirable under particular circumstances.

Those of skill in the art are also aware that a desired balance of cations can be achieved using similar principals and methods. For example, an organic acid in the form of its sodium salt may be directly blended with an acid copolymer to produce a phase transition material for use in the inventions. Further neutralization, if necessary or desirable, may be provided by adding one or more additional neutralizing agents, such as magnesium hydroxide or the like, to the blend. Alternatively, an acid copolymer may be neutralized with a blend of salts of one or more organic acids, the ratio of whose cations corresponds stoichiometrically to the ratio that is desired in the ionomer. Also, an ionomer including one cation may be blended with one or more salts of organic acids that comprise one or more different cations. Over neutralization, if any, may be corrected by back titration with an acid. In these instances, assuming typical melt blending and extruder processing methods are used, it is expected that the concentrations of the cations will be uniform throughout the bulk of the polymer blend. Again, those of skill in the art recognize that other permutations are possible, and are able to determine which methods of manipulating the cation levels may be desirable under a particular set of circumstances.

In addition, a phase transition material suitable for use in the present invention may optionally comprise one or more additional polymeric components. Suitable additional polymeric components include a second ethylene acid copolymer or ionomer according to the description above, or other thermoplastic resins, for example. Suitable thermoplastic resins include, without limitation, thermoplastic elastomers, such as polyurethanes; polyetheresters; polyamide ethers; polyether ureas; HYTREL® polyester elastomer, available from DuPont; PEBAX™ block copolymers based on polyether-block-amide, available from Atofina Chemicals, Inc., of Philadelphia, Pa.; styrene-butadiene-styrene (SBS) block copolymers; styrene(ethylene-butylene)-styrene block copolymers; polyurethanes; methylcellulose; 4,6-nylon; 6-nylon; polyamides in general (oligomeric and polymeric); polyesters; polyvinyl alcohol; polyolefins including polyethylene, polypropylene, and ethylene/propylene copolymers; metallocene catalyzed polyolefins, ethylene copolymers with various comonomers, such as ethylene/vinyl acetate, ethylene/(meth)acrylates, ethylene/(meth)acrylic acid, ethylene/maleic acid, monoester, ethylene/maleic acid, ethylene/(meth)acrylate/maleic acid, monoester, ethylene/(meth) acrylate/maleic acid, ethylene/epoxy-functionalized monomer, ethylene/CO; metallocene catalyzed ethylene and its copolymers with, e.g., polyvinyl alcohol or polyacrylate; ethylene/vinyl alcohol copolymers, such as ELVAL™, available from Kuraray Co., Ltd., of Tokyo, Japan; functionalized polymers with grafted maleic anhydride functionality and epoxidized polymers; elastomers, such as ethylene propylene diene monomer (EPDM); metallocene catalyzed polyethylene and its copolymers; ground up powders of the thermoset elastomers; and the like.

Preferably, the additional polymeric component comprises a copolymer of ethylene including, for example, ethylene copolymers with various comonomers, such as ethylene/vinyl acetate, ethylene/(meth)acrylates, ethylene/maleic acid, ethylene/maleic acid monoester, ethylene/(meth)acrylate/maleic acid, ethylene/(meth)acrylate/maleic acid monoester, ethylene/(meth)acrylic acid and ionomers thereof, ethylene/epoxy-functionalized monomer, ethylene/CO, ethylene/vinyl alcohol, or a blend comprising at least one of these. More preferably, the additional polymeric component comprises a polymer selected from the group consisting of: ethylene vinyl acetate (EVA); ethylene/alkyl(meth)acrylate; ethylene/(meth)acrylic acid and ionomers thereof; or a blend comprising at least one of these.

If included, the amount of the optional additional polymeric component may be present in a finite amount up to, in increasing order of preference, about 99%, about 75%, about 50%, about 25%, about 10%, about 5% or about 1% by weight, based on the total weight of the phase transition material.

Other additives that may be useful in the phase transition material include one or more fillers. The optional filler component of the subject invention is typically chosen to impart additional density to blends of the previously described components, the selection being dependent upon the intended use of the composition (e.g. the type of golf ball desired (i.e., one-piece, core of two-piece, core or/and intermediate layers of three-piece or multi-piece balls), as will be more fully detailed below).

Generally, the filler will be inorganic having a density greater than about 4 gm/cc, preferably greater than 5 gm/cc, and will be present in amounts between 0 and about 60 parts per hundred parts by weight of the ionomer, organic acid and thermoplastic elastomer polymer. Examples of useful fillers include metallic fillers, such as iron, steel, lead, tungsten and the like, zinc oxide, barium sulfate, lead silicate and tungsten carbide, tin oxide, as well as the other well known corresponding salts and oxides thereof. It is preferred that the filler materials be non-reactive or almost non-reactive with the polymer components described above when the ionomers are less than completely neutralized. If the ionomers are fully neutralized, reactive fillers may be used. Zinc oxide grades, such as Zinc Oxide grade XX503R available from Zinc Corporation of America, that have low reactivity with any free acid to cause cross-linking and a drop in MI are preferred, particularly when the ionomer is not fully neutralized. Titanium dioxide may be used as a filler, a whitening agent, or a pigment.

Other additives that may be useful in the invention include diacids such as adipic, sebacic or dodecanedioic acid, or an acid copolymer wax (e.g., Allied wax AC143 believed to be an ethylene/16-18% acrylic acid copolymer with a number average molecular weight of 2,040 Da).

Suitable phase transition materials may also include such other additives as are conventional in polymer compositions, for example, antioxidants, UV stabilizers, flame retardants, plasticizers, pigments, processing aids, optical brighteners, surfactants, and the like. Suitable levels of these additives and methods of incorporating these additives into polymer compositions will be known to those of skill in the art. See, e.g., "Modern Plastics Encyclopedia", McGraw-Hill, New York, N.Y. 1995.

In one embodiment, the present invention provides a golf ball comprising a phase transition material and a susceptor. The suitable and preferred phase transition materials for use in this embodiment are as set forth above. The term "susceptor", as used herein, refers to any material that is capable of transforming energy, which may be in the form of radiation or a field, into thermal energy. As used herein, the term "susceptor" does not include organic acids or materials that are known to have been used in golf balls as fillers and in amounts that are typical of fillers. The energy sought to be converted to heat is typically radiofrequency (RF) or high frequency (HF) energy. Typical RF power supplies for susceptor heating provide power in a range of from about 1 to about 20 kW.

Preferred susceptors include, without limitation, microwave susceptors and induction susceptors. Suitable microwave susceptors include metals, inorganic compounds such as silicon carbide, and the like. Suitable induction susceptors also include metals such as molybdenum, stainless steel, niobium, aluminum, silicon carbide, graphite and other conductive materials, in addition to ceramic flakes, including flakes of ferromagnetic ceramics, for example. For convenience, susceptors may be added to the phase transition materials via conventional methods, such as pre-extrusion melt mixing. To promote uniformity of distribution of the susceptor throughout the golf ball, or throughout the desired portion of the golf ball, it is preferable that the susceptors be in the form of small particles, such as powders or flakes, for example.

In some embodiments of the phase transition golf ball, the phase transition material may comprise the microwave susceptor or induction susceptor. Alternatively, the phase transition material may comprise at least a portion of the microwave susceptor or the induction susceptor, or the phase transition material and the microwave susceptor or induction susceptor may be located in different parts of the golf ball. For example, the phase transition material may be located in the core, and the microwave susceptor or induction susceptor may be located in an intermediate layer or mantle. When the susceptor(s) ands the phase transition material are not located in the same portion of the golf ball, the susceptor(s) increase the efficiency of the heating of the portion of the golf ball in which they reside. The temperature of the portion in which the phase transition material resides is raised by conduction of the heat to the phase transition material from the susceptor-enhanced portion of the golf ball.

Advantageously, including a susceptor in a phase transition golf ball may increase the speed or efficiency with which the temperature of the phase transition golf ball is raised to the desired level. For example, many polymers have relatively low heat transfer coefficients. Therefore, a relatively long period of time may be required to achieve a uniform depth profile of temperature throughout a polymer sample that is about the size of a golf ball. It may therefore be advantageous to include a susceptor in the core of a phase transition golf ball. The exterior of this phase transition golf ball may be heated via conduction or convention, and the core may be heated via electromagnetic energy, to achieve, in a relatively shorter time, a uniform depth profile of temperature throughout the phase transition golf ball. In this connection, it is apparent that susceptor heating may be used independently of or in conjunction with other forms of heating, such as conductive or convective heating. It is further apparent that over heating the phase transition golf ball, by any method, could lead to undesirable degradation of performance properties and deformation, for example through partial or complete melting of the golf ball.

The phase transition materials may be substituted for one or more materials taught in the art at the levels taught in the art for use in covers, cores, centers, intermediate layers in multi-layered golf balls, or one-piece golf balls. When used in a cover, in an intermediate layer or mantle, or in a core or center of a golf ball, or in a one-piece golf ball, the phase transition material is preferably present at a level of 100 wt %, 90 wt %, 80 wt %, 70 wt %, 60 wt %, 50 wt %, 40 wt %, 30 wt %, 20 wt %, 10 wt %, 5 wt %, 2 wt %, or in a finite amount, based on the total weight of the cover, inner layer or mantle, or core. It is expected that the phase transition effects will increase in magnitude with increasing amounts of phase transition material in the given golf ball component. It is also expected that the phase transition effects will increase in magnitude with increasing volume of the given golf ball component.

A detailed description of golf ball fabrication, structures and materials is available in U.S. Patent Appln. Publn. No. 2007/0203277. Briefly, however, the phase transition golf ball may be made by any suitable means of golf ball fabrication. Sufficient fillers can be added to one or more components of the golf ball to adjust the weight of the golf ball to a level meeting the limits set by the golfer's governing authority. See, for example, U.S. Pat. Nos. 4,274,637; 4,264,075; 4,323,247; 4,337,947, 4,398,000; 4,526,375; 4,567,219; 4,674,751; 4,884,814; 4,911,451; 4,984,804; 4,986,545; 5,000,459; 5,068,151; 5,098,105; 5,120,791; 5,155,157; 5,197,740; 5,222,739; 5,253,871; 5,298,571; 5,321,089; 5,328,959; 5,330,837; 5,338,038; 5,338,610; 5,359,000; 5,368,304; 5,810,678; 5,971,870; 5,971,871; 5,971,872; 5,973,046; 5,810,678; 5,873,796; 5,757,483; 5,567,772; 5,976,443; 6,018,003; 6,096,830; and International Patent Appln. Publn. No. WO 99/48569.

Golf balls generally have surface contouring to affect their aerodynamic performance. This surface contouring is typically embodied by small, shallow depressions ("dimples") molded into the otherwise spherical surface of the golf ball. The dimples can be arranged in any one of a number of patterns to modify the flight characteristics of the balls. Any dimple pattern is contemplated in the phase transition golf balls described herein.

Golf balls typically comprise layers of materials in their construction. The outermost layer, not including any paint, surface treatment or marking, of a golf ball is known as the cover. The cover may be coated with a urethane lacquer or be painted for appearance purposes, but such a coating and/or painting will not affect significantly the performance characteristics of the ball. Covers can be made from any traditional golf ball cover material such as ethylene copolymers, acid copolymer, Surlyn® ionomer resin, thermoplastic elastomers, balata rubber or thermoset/thermoplastic polyurethanes and the like and their blends, and include the surface contouring or dimple pattern. The innermost layer is known as the center or core. Intermediate layers between the cover and the core are also known as mantles, inner covers, casing layers, outer core of double cores, or dual cores Three-Piece Golf Ball As used herein, the term "three-piece ball" refers to a golf ball comprising a center or core, an elastomeric winding wound around the center or a injection/compression molded mantle, and a cover. Three-piece golf balls are manufactured by well known techniques, for example as described in U.S. Pat. No. 4,846,910 for example. The phase transition material may be used in the cover, mantle, or the center of such balls in combination with other materials typically used in these components.

Two-Piece Golf Ball

As used herein, the term "two-piece ball" refers to a golf ball comprising a core and a cover. These two-piece balls are manufactured by first molding the core from a thermoset or thermoplastic composition, positioning these preformed cores in injection molding cavities using retractable pins or compression molding cavities, then injection or compression molding the cover material around the cores. The phase transition material may be used in the cover or the core of such balls alone or in combination with other materials typically used in these components.

Multi-Layer Golf Ball

As used herein, the term "multi-layer ball" refers to a golf ball comprising a core or center, a cover made from any viable golf ball cover material, and one or more mantles or intermediate layers between the core and the cover. These multi-layer balls are manufactured by first molding or making the core or center, typically compression or injection molding at least one mantle or intermediate layer over the core or center and then compression or injection molding at least a cover over the mantle(s) or the intermediate layers. The phase transition material may be used in the cover, the one or more mantles or the core or center of such balls alone or in combination with other materials typically used in these components.

One-Piece Golf Ball

As used herein, the term "one-piece ball" refers to a golf ball molded from a single thermoplastic or thermoset composition, i.e., having neither elastomeric windings nor a cover. These one-piece balls are manufactured by direct injection molding techniques or by compression molding techniques. The phase transition material by itself or in blends may be used in such balls in combination with other materials typically used in these balls.

Further provided are methods of using phase transition golf balls. In one embodiment, an off-the-shelf golf ball can be customized to various pre-determined compressions by applying heat. For example, the golf ball can be heated to a specific temperature in a microwave for a certain number of seconds to achieve a certain compression level. By changing the heating time to adjust the final temperature, one can customize the compression level. The compression level may be measured with an Atti compression gauge, for example. The compression level can be related to golfer handicap level, swing speed, outside temperatures, etc. Therefore, a golfer will have the ability to customize off-the-shelf golf balls to match his or her individual skill level or temperature conditions of play by heating the golf ball and playing the golf ball within the extended time after thermally treating the balls. In addition, the golf ball may be reheated many times and still continue to allow customization of the compression level.

Further, in this preferred embodiment, the performance properties of the ball may be adjusted to a desired compression range based on individual preferences. Alternatively, the performance properties of the ball may be adjusted to correlate with one or more of the parameters that are used to specify the design of a custom-fitted set of golf clubs, including, without limitation, gender, age, height, arm length, hand size, wrist-to-floor distance, club length, handicap, swing speed, swing tempo, swing trajectory, loft, lie, grip, swing weight, driver distance (carry and roll), ball flight pattern, and choice of club at 150 yard marker. Other parameters to which the customizable golf ball performance properties may be correlated include weather conditions, for example.

As noted above, the heat transfer within a relatively large polymer aliquot, such as a sample about the size of a golf ball, is relatively slow. In such cases, it may be advantageous to use a filler with a lower thermal transfer coefficient, so that the filler will retain heat and cause the surrounding polymer to heat up relatively quickly. In this way, a uniform depth profile of temperature may be achieved more efficiently. Conversely, it may also be advantageous to employ a filler with a relatively high thermal transfer coefficient, to improve the efficiency of the step of cooling the phase transition golf ball to ambient temperature. Metals, such as tungsten, iron, aluminum and titanium, have higher coefficients of thermal conductivity. Materials that are more similar to ceramics, such as metal oxides including zinc oxide, tungsten oxide, alumina, silica and titania; talcs, clays, zeolites and the like have lower coefficients of thermal conductivity.

In another embodiment, the invention provides means for accelerating the heating at least a portion of a golf ball. In this invention, the portion(s) of the golf ball that are capable of accelerated heating are those portions that comprise a phase transition material and a microwave susceptor or induction susceptor.

In this method, a golf ball comprises a microwave susceptor or an induction susceptor. The microwave susceptor or the induction susceptor is located in at least a portion of the golf ball, and the locations of the microwave susceptor and the induction susceptor, if both are present, may be the same or different and are independently selected. The golf ball is heated via microwave radiation or an induction field, whereby the portion of the golf ball comprising the microwave susceptor or the induction susceptor is heated more rapidly or to a higher temperature in comparison with a golf ball that does not contain the microwave susceptor or the induction susceptor or in comparison with a portion of the golf ball that does not contain the microwave susceptor or the induction susceptor.

The suitable and preferred phase transition materials, types and amounts of microwave susceptors and induction susceptors, and portions of the golf ball are as described above with respect to the phase transition golf ball. The means for heating the golf ball include any means known to those of skill in the art to be suitable for analogous purposes, e.g., microwave cavities, microwave ovens, induction coils and induction furnaces.

In another embodiment, the invention provides a method of customizing the performance of a golf ball, comprising providing a phase transition golf ball comprising a phase transition material; and inducing a phase transition in at least a portion of the phase transition material. In a preferred embodiment, the phase transfer material comprises an acid copolymer or an ionomer of an acid copolymer, and, optionally, an organic acid.

In another embodiment, the invention provides a method of using heat to improve the performance of a golf ball, wherein the improvement comprises that the golf ball comprises a phase transition material, and further that the golf ball is heated to a temperature at which at least a portion of the phase transition material undergoes a phase transition. In this embodiment, the phase transition golf balls are as described above, and the improvements are as described above with respect to the phase transition golf balls and with respect to the methods of the invention.

Further provided by the present invention are means to tailor the stiffness of a single type of phase transition golf ball to suit the needs and preferences of different players. The means are as described above with respect to the phase transition golf ball and with respect to the methods of the invention.

In another embodiment, the invention provides a kit comprising one or more of a phase transition golf ball, instructions, a heating chart including information about the golf ball's performance when heated to different temperatures, software for determining a heating temperature or a heating time or an electromagnetic frequency (as for induction heating or microwave heating), a heating device such as a mantle, a voltage controller, an induction coil, or the like.

As a footnote, in the past golf balls were imprinted with the value of their compression. Moreover, golf balls with one of only two compression ratings, 90 or 100, were available. By custom, "average" golfers were encouraged to play with the golf balls that had the lower compression rating, and "proficient" golfers used the balls with the higher rating. (According to a competing theory, however, less skilled golfers were encouraged to use golf balls of higher stiffness, to minimize hook or slice shots, and more skilled golfers were encouraged to use softer golf balls, for better control. Whence, no doubt, the predominating effect of idiosyncratic preferences.)

In certain embodiments, however, the present invention overcomes the disadvantages resulting from these limited choices and from the stereotypical, if inconsistent, implications of those choices. Using the golf balls and methods described herein, two golfers may select identical golf balls, with identical manufacturer's markings, and each may alter the performance properties of his or her ball to suit him or herself. In addition, the altered performance properties are not apparent from the appearance of the ball. Thus, the performance properties may also be concealed from other players.

As a second footnote, phase transition golf balls and methods of using phase transition golf balls are discussed at length herein. There are objects other than golf balls, however, in which phase transition materials may advantageously be included. For example, the blade of an ice hockey stick may comprise a phase transition material, such as an acid copolymer or an ionomer of an acid copolymer. Such a blade may be pre-heated, prior to an ice hockey game, so that it will be softer with approximately the same resilience. The hockey player using the phase transition hockey stick will realize benefits such as a better feeling of connection with the hockey puck and greater control of the spin and direction of his or her shots.

These and other advantages extend to other articles of sporting goods, such as, for example, helmets, golf clubs, inserts, grips, protective padding, footwear and footwear components. In addition, the advantages of phase change materials extend to other end uses that are not related to games, such as, for example, car hood liners that have better sound insulation properties at higher temperatures. The use of the compositions and methods of the invention is contemplated for any object that may comprise a phase transition material as described herein.

The following examples are provided to describe the invention in further detail. These examples, which set forth a preferred mode presently contemplated for carrying out the invention, are intended to illustrate and not to limit the invention.

EXAMPLES

Three spheres were fabricated from each of the materials described in Table 1, below, by injection molding. The newly molded spheres were conditioned by storing them at room temperature under ambient conditions for at least two weeks.

TABLE 1

| Materials Tested. | |
|---|---|
| Example No. | Material Tested |
| 1 | E/15.5nBA/8.5AA[1] with 38% Mg stearate and neutralized by $Mg(OH)_2$ to nominally 98% total neutralization |

TABLE 1-continued

| Materials Tested. | |
|---|---|
| Example No. | Material Tested |
| 2 | E/15.5nBA/10.5AA with 35% oleic acid and neutralized by $Mg(OH)_2$ to nominally 115% total neutralization |
| 3 | Polymer of Example 2 with $BaSO_4$ filler; specific gravity = 1.14 g/cm$^3$ |
| 4 | 50:50 blend of E/19MAA neutralized 40% with $Mg(OH)_2$ (MI = 1.1 dg/min) with E/23.5nBA/9MAA neutralized to 51% with $Mg(OH)_2$ (MI = 0.95 dg/min) |
| 5 | E/11MAA, neutralized 37% with $Na^+$ (MI = 10) |
| 6 | E/10iBA/10MAA neutralized 73% with ZnO (MI = 1.0 dg/min) |
| 7 | E/6.2AA/28nBA with 35% oleic acid and neutralized by $Mg(OH)_2$ to 117% |
| 8 | E/6.2AA/28nBA with 20% AC540 (E/5%AA available from Honeywell) neutralized with $Mg(OH)_2$ to 83% |
| Comparative | Thermoset (TS) rubber core |

[1]Notes for Table 1: (a) abbreviations for copolymerized residues: E refers to ethylene; nBA refers to n-butyl acrylate; MAA refers to methacrylic acid; AA refers to acrylic acid; iBA refers to isobutyl acrylate (b) abbreviations for polymer compositions: "E/15.5nBA/8.5AA", for example, refers to a base polymer comprising copolymerized residues of n-butyl acrylate (15.5%), acrylic acid (8.5%) and ethylene (remainder, or, here, 76%), wherein the percentages are by weight based on the total weight of the copolymer prior to neutralization; (c) melt index (MI) was measured in accord with ASTM D-1238, condition E, at 190° C., using a 2160 gram weight.

After this conditioning, the Atti compression of each sphere was measured with an Atti Compression Gauge, which measures resistance to deformation. Each measurement was replicated twice, so that every data point in the Figures represents the average of nine measurements.

Each conditioned sphere was heated in an oven for at least 24 h at either 120° F. (48.9° C.), 135° F. (57.2° C.) or 149° F. (65.0° C.), with the exception of Examples 5 through 8, for which the spheres were heated to 120° F. (48.9° C.) only. This length of time is believed to be sufficient to guarantee that the entire ball has reached the target temperature. The Atti compression and coefficient of resilience of each heated sphere was then re-measured, by the methods identified above, immediately upon removal from the oven and at intervals of about 1, 2, 4, 24, 72, and 168 hours after removal from the oven. The results of these measurements are tabulated in Table 2. The data obtained for Examples 1 through 5 and the Comparative Example are displayed in FIGS. 1 through 6, in which the horizontal dashed lines represent the value of the Atti compression prior to the oven treatment.

TABLE 2

| Compression Data for Materials in Table 1 | | | | | | | | | | | | |
|---|---|---|---|---|---|---|---|---|---|---|---|---|
| | Example: | | | | | | | | | | | |
| | 1 | 1 | 1 | 2 | 2 | 2 | 3 | 3 | 3 | 4 | 4 | 4 |
| Oven Temperature (° C.) | 49 | 57 | 65 | 49 | 57 | 65 | 49 | 57 | 65 | 49 | 57 | 65 |
| Pretest Compression | 120 | 118 | 120 | 95 | 99 | 99 | 106 | 108 | 108 | 89 | 93 | 94 |
| Compression immediately after removing from oven | 78 | 68 | 53 | 59 | 51 | 24 | 73 | 60 | 36 | 33 | 61 | 79 |
| 1 Hr after removal | 91 | 81 | 75 | 83 | 74 | 67 | 93 | 85 | 75 | — | — | — |
| 2 Hrs after removal | 93 | 88 | 82 | 83 | 79 | 69 | 91 | 89 | 81 | 42 | 54 | 43 |
| 4 Hrs after removal | 94 | 91 | 88 | 84 | 81 | 73 | 93 | 91 | 85 | 64 | 65 | 67 |
| 24 Hrs after removal | 103 | 100 | 96 | 88 | 85 | 80 | 99 | 95 | 88 | 75 | 77 | 78 |
| 3 Days after removal | 106 | 103 | 103 | 90 | 88 | 83 | 101 | 97 | 92 | 78 | 83 | 82 |
| 1 Week after removal | 110 | — | — | 92 | — | — | 103 | — | — | 81 | — | — |

TABLE 2-continued

| Compression Data for Materials in Table 1 | | | | | | | |
|---|---|---|---|---|---|---|---|
| | Example: | | | | | | |
| | 5 | 6 | 7 | 8 | C.E.[1] | C.E. | C.E. |
| Oven Temperature (° C.) | 49 | 49 | 49 | 49 | 49 | 57 | 65 |
| Pretest Compression | 157 | 127 | 59 | 81 | 77 | 78 | 83 |
| Compression immediately after removing from oven | — | — | — | — | 76 | 70 | 77 |
| 1 Hr after removal | 100 | 55 | 39 | 13 | 74 | 76 | 77 |
| 2 Hrs after removal | 147 | 105 | 41 | 46 | 75 | 76 | 81 |
| 4 Hrs after removal | 150 | 111 | 43 | 52 | 76 | 76 | 81 |
| 24 Hrs after removal | 148 | 119 | 49 | — | 79 | 77 | 75 |
| 3 Days after removal | 155 | 121 | 53 | — | 79 | 77 | 80 |
| 1 Week after removal | 148 | 122 | 55 | 76 | 80 | — | — |

[1]C.E. = Comparative Example

Referring now to FIG. 1, the data depicted therein demonstrate that the compression of the phase change material of Example 1 is affected strongly by the heat treatment. This graph of compression vs. time shows a rapid stiffness increase in the first few hours immediately after removal from the oven. This is the thermal effect caused by cooling the ball to room temperature. After the ball has reached room temperature, the stiffness stabilizes at a level that is significantly lower than the baseline level. This stable lower level of compression is due to the phase transition induced by the heat treatment. FIG. 1 shows that the effects of the phase transition persist for a significant period of time, here specifically at least one week.

Moreover, the compression of the sphere that was heated at 149° F. (65.0° C.) was lower than that of the sphere that was heated at 120° F. (48.9° C.) at every measurement interval for which both spheres were measured. Also, the average of the compression measurements of the sphere that was heated at 149° F. (65.0° C.) was lower than the average of the compression measurements of the sphere that was heated at 120° F. (48.9° C.).

Thus, in customizing the properties of a golf ball that contains a significant amount of the phase change material of Example 1, the extent of the change in compression is a function of the temperature at which the ball is heated. Conversely, being aware of the relationship between the compression and the temperature at which the ball is heated, a golfer may select a treatment temperature for the ball that is appropriate to achieve the compression that is desired.

Figure 2:
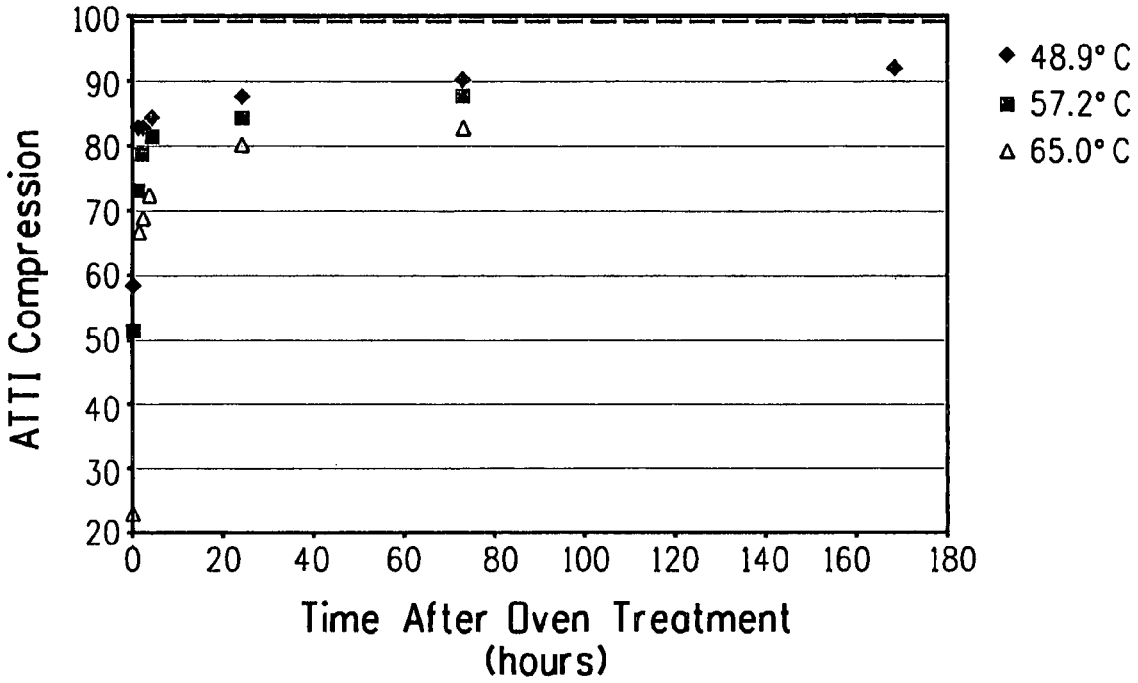
FIG. 2 is a graph showing the effect of heating on the ATTI compression of spheres of a second phase transition material.
Figure 3:
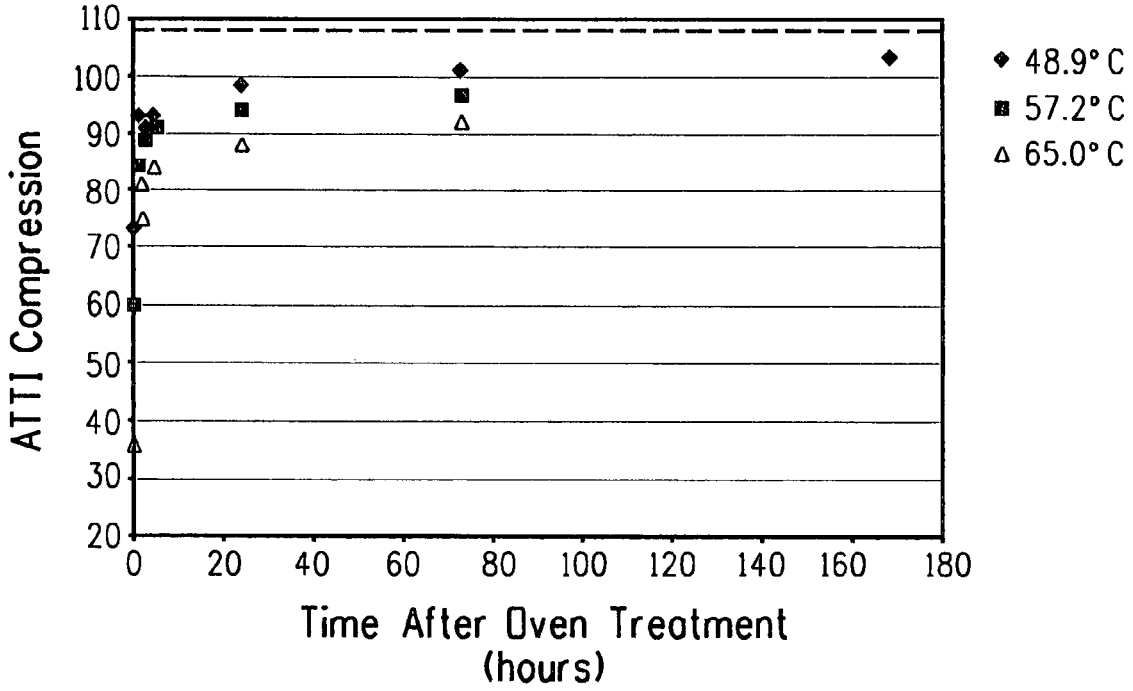
FIG. 3 is a graph showing the effect of heating on the ATTI compression of spheres of the second phase transition material, filled with barium sulfonate.

Likewise, the data depicted in the graphs of FIGS. 2 and 3 also demonstrate that the compression of the phase change material of Example 2 is decreased markedly by the heat treatment, and that the properties return more rapidly towards their baseline in the first 1 to 2 hours after heating, due to thermal effects, than they do afterwards, when the effects on the performance properties are determined in large part by the phase transition. The presence of the $BaSO_4$ filler in the phase transition material of Example 3 appears to affect the absolute values of the compressions more strongly than it affects the shape of the compression vs. time curves.

Figure 4:
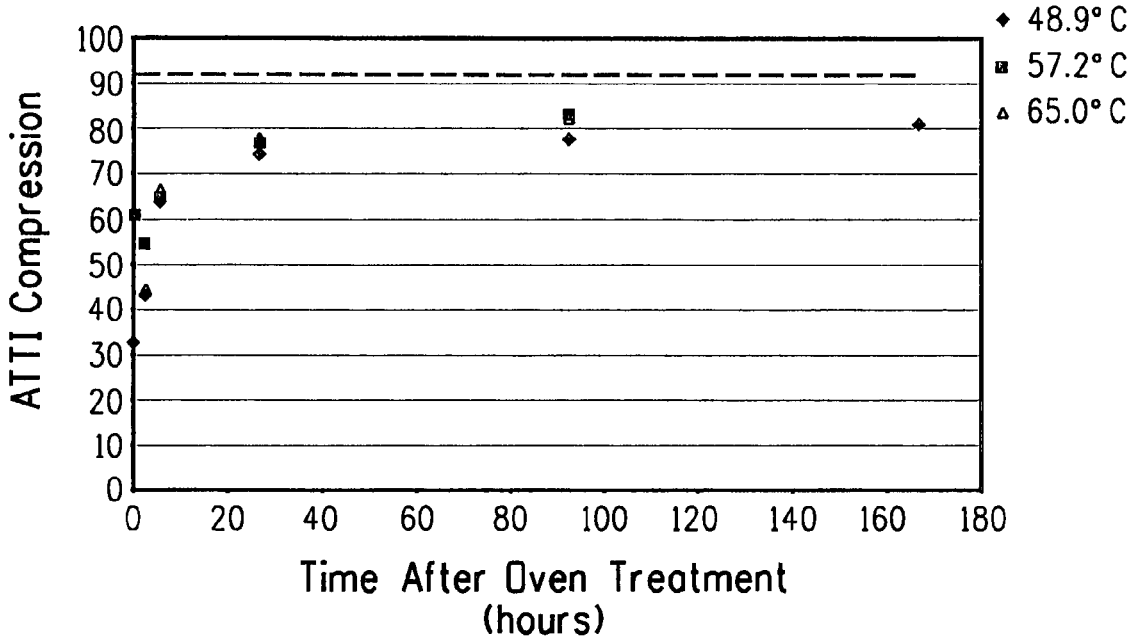
FIG. 4 is a graph showing the effect of heating on the ATTI compression of spheres of a third phase transition material.

Referring now to FIG. 4, this graph shows the compression vs. time data for the spheres of Example 4. In these spheres, the phase transition materials comprise one or more ethylene acid copolymers and are essentially free of organic acids. These data also support conclusions that are consistent with the conclusions reached in the analysis of Examples 1, 2 and 3.

Figure 5:
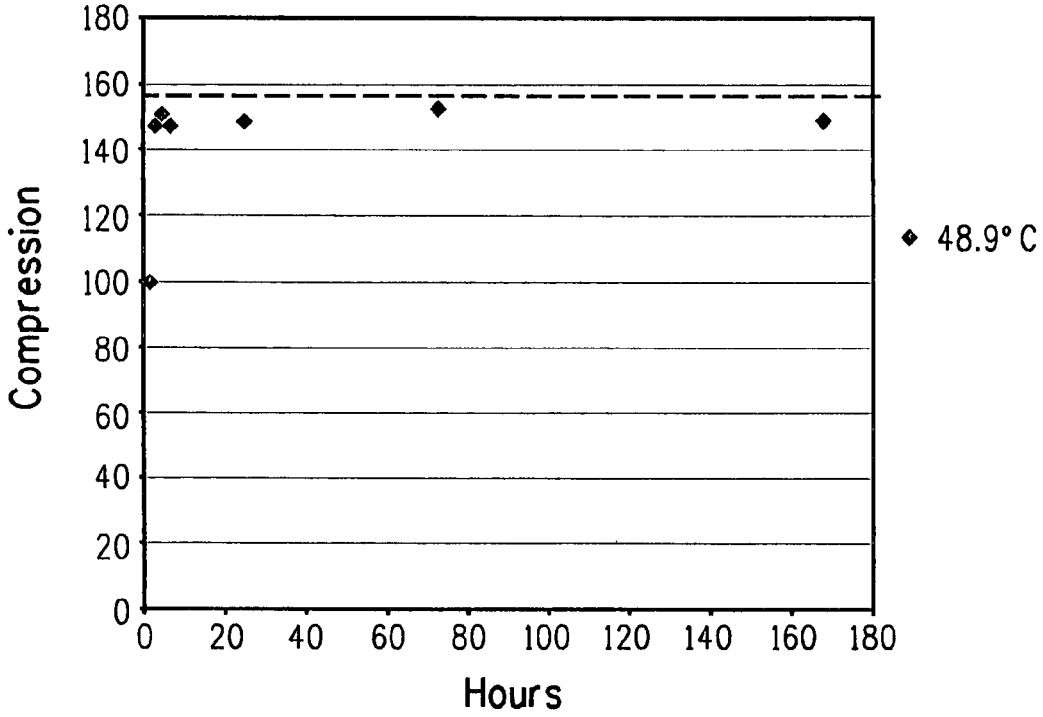
FIG. 5 is a graph showing the effect of heating on the ATTI compression of spheres of a fourth phase transition material.

FIG. 5, however, shows data for Example 5, a dipolymer that has a higher temperature phase transition, so that when it is heated at 49° C. there is a substantial thermal softening effect, but after only 2 hours it has recovered 94% of its compression.

Example 6 is a terpolymer, Example 7 is a terpolymer containing 35 wt % fatty acid salt, and Example 8 is a terpolymer blend with a low molecular weight E/5% M wax. The measurements of these examples also support conclusions that are consistent with the conclusions reached in the analysis of Examples 1 through 4.

Figure 6:
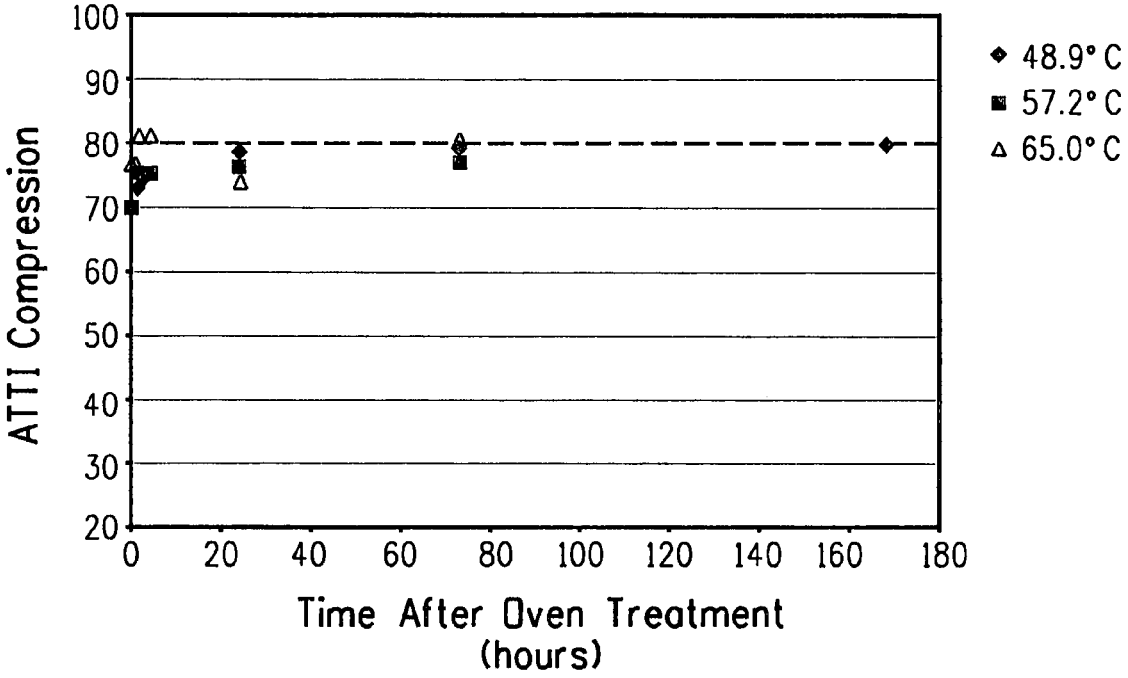
FIG. 6 is a graph showing the effect of heating on the ATTI compression of a typical thermoset rubber core.

In contrast, however, the data depicted in FIG. 6 show that the compression of the traditional thermoset rubber core changed very little upon heating, from a baseline compression of 79.3 to an average compression of 74.3, or 6.3% less than baseline, immediately upon removal from the oven. Moreover, the properties of the rubber core returned to their baseline values more rapidly than those of the phase change materials. The shape of the compression vs. time curves in FIG. 6 indicate appears to be linear, overall, in the interval before the compression returns to its baseline value. Last, there appears to be little difference between the magnitudes of the changes in compression based on the temperatures at which the rubber cores were heated. The data in FIG. 6 support the view that the performance changes caused by heating the thermoset rubber core are due mainly to thermal effects. Moreover, the thermal effects are essentially insignificant after about an hour, or once the sphere has reached room temperature.

While certain of the preferred embodiments of the present invention have been described and specifically exemplified above, it is not intended that the invention be limited to such embodiments. Various modifications may be made without departing from the scope and spirit of the present invention, as set forth in the following claims.

What is claimed is:

1. A method of customizing the performance of a golf ball, said method comprising the steps of providing a phase transition golf ball comprising a phase transition material; predetermining an extent of a phase transition; inducing the phase transition in at least a portion of the phase transition material, wherein the phase transition remains at least partially unreversed for an extended period of time; and measuring a property affecting the playability of the phase transition golf ball; wherein the property is altered to a predetermined extent by predetermining the extent of the phase transition.

2. The method of claim 1, wherein the phase transition is induced by heating the phase transition golf ball.

3. The method of claim 2, wherein the phase transition golf ball is heated by conduction heating, by convection heating, by induction heating, or by microwave irradiation.

4. The method of claim 3, wherein the phase transition golf ball is heated in a warm water bath, a boiling water bath, a steam bath, a conventional oven, in a glove compartment, in a trunk of a car, in a microwave oven, by removal from a cold environment, or by magnetic induction.

5. The method of claim 1, wherein the extended period of time is at least about 4 h, 8 h, 12 h, 24 h, 3 d, 7 d, 10 d, 14 d, 21 d, or 28 d.

6. The method of claim 1, wherein the property affecting the playability of the phase transition golf ball is selected from the group consisting of hardness, stiffness, compression, resilience, launch angle, spin, and initial velocity.

7. The method of claim 1, wherein the phase transition material comprises an acid copolymer or an ionomer of an acid copolymer, and, optionally, an organic acid.

8. The method of claim 7, wherein the phase transition golf ball is heated to a temperature greater than 120° F. (49° C.), 135° F. (57° C.) or 149° F. (65° C.).

9. The method of claim 1, further comprising the steps of: allowing the phase transition to reverse at least partially; once more inducing a phase transition in at least a portion of the phase transition material; and, optionally, repeating the steps of allowing the phase transition to reverse at least partially and once more inducing a phase transition in at least a portion of the phase transition material.

10. The method of claim 1, wherein the phase transition material comprises a material selected from the group consisting of paraffin waxes, copolymers of ethylene and vinyl acetate, ethylene acrylate copolymers, acid copolymers, and ionomers of acid copolymers.

11. The method of claim 1, wherein the phase transition is selected from the group consisting of melting, solidification, changing from a crystalline to a more amorphous state, and glass transition.

12. The method of claim 1, wherein the phase transition material further comprises one or more additional polymeric components selected from the group consisting of an ethylene acid copolymer or an ionomer of an ethylene acid copolymer; a styrene-butadiene-styrene block copolymer; a styrene (ethylene-butylene)-styrene block copolymer; a polyurethane; a methylcellulose; an oligomeric or polymeric polyamide; a polyester; a polyvinyl alcohol; a polyolefin selected from the group consisting of a polyethylene, a polypropylene, and an ethylene/propylene copolymer; a metallocene-catalyzed polyolefin; an ethylene copolymer selected from the group consisting of ethylene/vinyl acetate, ethylene/(meth)acrylate, ethylene/(meth)acrylic acid, ethylene/maleic acid monoester, ethylene/maleic acid, ethylene/(meth)acrylate/maleic acid monoester, ethylene/(meth)acrylate/maleic acid, ethylene/epoxy-functionalized monomer and ethylene/CO; a metallocene-catalyzed copolymer of ethylene with a polyvinyl alcohol or a polyacrylate; an ethylene/vinyl alcohol copolymer; a functionalized polymer with grafted maleic anhydride functionality and epoxidized polymer; an ethylene propylene diene monomer (EPDM); a ground up powder of a thermoset elastomer; and a thermoplastic elastomer selected from the group consisting of polyurethanes, polyetheresters, polyamide ethers, polyether ureas and block copolymers based on polyether-block-amide.

13. The method of claim 1, wherein the phase transition golf ball further comprises a microwave susceptor or an induction susceptor.

14. The method claim 13, wherein the microwave susceptor or the induction susceptor comprises one or more of a metal, an inorganic compound, another conductive material, or a ceramic flake.

15. The method of claim 14 wherein the microwave susceptor or the induction susceptor comprises one or more of molybdenum, stainless steel, niobium, aluminum, silicon carbide, graphite, or a ferromagnetic ceramic flake.

16. The method of claim 1, wherein the phase transition golf ball further comprises a filler having a higher thermal transfer coefficient.

17. The method of claim 16, wherein the filler is a metal selected from the group consisting of tungsten, iron, titanium and aluminum.

18. The method of claim 1, wherein the phase transition golf ball further comprises a filler having a lower thermal transfer coefficient.

19. The method of claim 18, wherein the filler is a metal oxide selected from the group consisting of zinc oxide, tungsten oxide, alumina, silica, titania, talc, clay, and zeolite.

* * * * *